United States Patent [19]

Singhal et al.

[11] Patent Number: 5,026,492

[45] Date of Patent: Jun. 25, 1991

[54] LUBRICATING OIL CONTAINING AN ALKYL ALKOXYALKYLXANTHATE AND ZINC DIALKYLDITHIOPHOSPHATE

[75] Inventors: Gopal H. Singhal, Baton Rouge, La.; Jacob J. Habeeb, Westfield, N.J.

[73] Assignee: Exxon Research & Engineering Company, Florham Park, N.J.

[21] Appl. No.: 404,037

[22] Filed: Sep. 7, 1989

[51] Int. Cl.[5] ..... C10M 135/14

[52] U.S. Cl. ..... 252/32.7 E; 252/48.2

[58] Field of Search ..... 252/32.7 E, 33.6, 47, 252/48.2

[56] References Cited

U.S. PATENT DOCUMENTS

| | | | |
|---|---|---|---|
| 2,410,650 | 11/1946 | Giammaria | 252/33.6 |
| 2,681,316 | 6/1954 | Harle | 252/47.5 |
| 2,694,682 | 11/1954 | Harle | 252/33.6 |
| 4,293,430 | 10/1981 | Rivier | 252/32.7 |

*Primary Examiner*—Prince E. Willis
*Assistant Examiner*—Ellen M. McAvoy
*Attorney, Agent, or Firm*—John W. Ditsler

[57] ABSTRACT

The addition of an alkyl alkoxyalkylxanthate and a metal thiophosphate to a lubricating oil results in an unexpected synergistic improvement in the antiwear performance of the oil. Butyl ethoxyethylxanthate and zinc dialkyldithiophosphate are most preferred additives.

8 Claims, No Drawings

LUBRICATING OIL CONTAINING AN ALKYL ALKOXYALKYLXANTHATE AND ZINC DIALKYLDITHIOPHOSPHATE

BACKGROUND OF THE INVENTION

1. Field of the Invention

This invention relates to a lubricating oil composition having improved antiwear performance due to the presence of an alkyl alkoxyalkylxanthate and a metal thiophosphate.

2. Description of Related Art

Engine lubricating oils require the presence of additives to protect the engine from wear. For almost forty years, the principal antiwear additive for engine lubricating oils has been zinc dialkyldithiophosphate (ZDDP). However, ZDDP must be used in concentrations of 1.4 wt. % or greater to be effective. Since phosphates may result in the deactivation of emission control catalysts used in automotive exhaust systems, a reduction in the amount of phosphorus-containing additives (such as ZDDP) in the oil would be desirable. In addition, ZDDP alone does not provide the enhanced antiwear protection necessary in oils used to lubricate today's small, high performance engines.

Certain alkyl alkoxyalkylxanthanes are also known. For example, s-hexyl 0-(2-methyoxyethyl) ester, which has the formula:

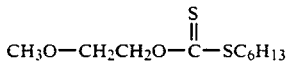

has a Chemical Abstracts Registry Number (RN=27098-36-8), but has not been used in lubricating oils. In addition, ethylene diisopropyl xanthate has been used in lubricants (see, for example, Russian Patent 655,717).

However, none of these publications suggest that the antiwear performance of a lubricating oil can be synergistically enhanced when certain alkyl xanthates and a metal thiophosphate are present therein.

SUMMARY OF THE INVENTION

This invention concerns a lubricating oil containing antiwear reducing amounts of certain alkyl xanthates and a metal thiophosphate. More specifically, we have discovered that the antiwear performance of a lubricating oil is synergistically enhanced when the oil contains a minor amount of an additive system containing an alkyl alkoxyalkylxanthate and a metal thiophosphate. Butyl ethoxyethylxanthate and zinc dialkyldithiophosphate are particularly preferred additives.

DETAILED DESCRIPTION OF THE INVENTION

In one embodiment, this invention concerns a lubricating oil composition comprising (a) a lubricating oil basestock, (b) an alkyl alkoxyalkylxanthate, and (c) a metal thiophosphate In another embodiment, this invention concerns a method for reducing the wear of an internal combustion engine by lubricating the engine with an oil containing an oil soluble additive system which comprises an alkyl alkoxyalkylxanthate and a metal thiophosphate.

In general, the lubricating oil will comprise a major amount of a lubricating oil basestock (or base oil) and a minor amount of an additive system which contains an alkyl alkoxyalkylxanthate and a metal thiophosphate. If desired, other conventional lubricating oil additives may be present in the oil as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The alkyl alkoxyalkylxanthate used in this invention has the general formula

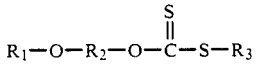

where $R_1$ is an alkyl group (straight, branched, or cyclic) containing from 1 to 10 carbon atoms, an alkoxy substituted alkyl group in which the alkoxy group contains from 1 to 4 carbon atoms, a polyalkoxy substituted alkyl group in which the polyalkoxy group contains from 2 to 10 repeating units, an aryl group, or a substituted aryl group, $R_2$ is a straight or branched alkylene group containing from 2 to 8, preferably from 2 to 4, carbon atoms, or a substituted aryl group, and $R_3$ is a straight or branched alkyl group containing from 1 to 9, preferably from 3 to 8, more preferably from 4 to 6, carbon atoms.

Preferably $R_1$ is a straight alkyl group containing from 1 to 10 carbon atoms, a branched alkyl group containing from 1 to 10 carbon atoms, or an alkoxy group containing from 1 to 4 carbon atoms. Most preferably, $R_1$ comprises a straight chain alkyl group having from 1 to 10 carbon atoms. $R_1$ and $R_2$ together should contain a sufficient number of carbon atoms such that the alkyl alkoxyalkylxanthate is soluble in the oil. Examples of suitable substituted groups in $R_1$ and $R_2$ include alkyl, aryl, hydroxy, alkylthio, amido, amino, keto, ester groups, and the like.

Examples of the various alkyl alkoxyalkylxanthates that can be used in this invention include butyl methoxyethylxanthate, butyl ethoxyethylxanthate, butyl phenoxyethylxanthate, butyl butoxyethylxanthate, butyl propyloxyethylxanthate, butyl ethoxybutylxanthate, butyl isopropyloxyethylxanthate, butyl ethoxyethoxyethylxanthate, methyl ethoxyethylxanthate, ethyl ethoxyethylxanthate, propyl ethoxyethylxanthate, hexyl ethoxyethylxanthate, octyl ethoxyethylxanthate, and octyl methoxyethylxanthate.

Preferred alkyl alkoxyalkylxanthates include octyl ethoxyethylxanthate, octyl methoxyethylxanthate, butyl methoxyethylxanthate, butyl ethoxyethylxanthate, butyl butoxyethylxanthate, butyl propyloxyethylxanthate, ethyl ethoxyethylxanthate, propyl ethoxyethylxanthate, and butyl ethoxyethoxyethylxanthate. Butyl ethoxyethylxanthate, butyl butoxyethylxanthate, butyl propyloxyethylxanthate, butyl ethoxyethoxyethylxanthate, and octyl ethoxyethylxanthate are more preferred, with butyl ethoxyethylxanthate being most preferred.

The metal thiophosphate used in this invention preferably comprises a metal selected from the group consisting of Group IB, IIB, VIB, VIII of the Periodic Table, and mixtures thereof. A metal dithiophosphate is a preferred metal thiophosphate, with a metal dialkyldithiophosphate being particularly preferred. Copper, nickel, and zinc are particularly preferred metals, with zinc being most preferred. The alkyl groups preferably comprise from 3 to 10 carbon atoms. Particularly preferred metal thiophosphates are zinc dialkyldithiophosphates.

The amount of alkyl alkoxyalkylxanthate and metal thiophosphate used in this invention need be only that which is necessary to cause an enhancement in the antiwear performance of the oil. Typically, however, the concentration of the alkyl alkoxyalkylxanthate in the lubricating oil will range from about 0.1 to about 5 wt. %, preferably from about 0.4 to about 1.5 wt. %, of the oil. The concentration of the metal thiophosphate will range from about 0.1 to about 2 wt. %, preferably from about 0.5 to about 1 wt. %, of the lubricating oil.

Metal thiophosphates are commercially available from a number of vendors. As such, their method of manufacture is well known to those skilled in the art. The alkyl alkoxyalkylxanthates can be readily prepared using the methods shown in Examples 1 and 2 below.

The additives (or additive system) of this invention can be added directly to the lubricating oil. Often, however, they can be made in the form of an additive concentrate to facilitate handling and introduction of the additives into the oil. Typically, the concentrate will contain a suitable organic diluent and from about 10 to about 90 wt. %, preferably from about 30 to about 80 wt. %, of the additives. Suitable organic diluents include mineral oil, naphtha, benzene, toluene, xylene, and the like. The diluent should be compatible (e.g. soluble) with the oil and, preferably, substantially inert.

A lubricating oil containing the additive system of this invention can be used in essentially any application where wear protection is required. Thus, as used herein, "lubricating oil" (or "lubricating oil composition") is meant to include automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples which are not intended to restrict the scope of the claims.

EXPERIMENTAL PROCEDURE

Valve train wear tests were performed in the following examples utilizing a Ford 2.3 liter engine with the pistons and connecting rods removed. The engine was driven by an 11.2 KW (15 horsepower) DC drive motor through a 1.2 timing belt drive. The engine was equipped with Oldsmobile valve springs (146.5–148.3 KG) to increase the load between the cam lobes and the followers. Oil and coolant were circulated using engine mounted pumps. All test runs were made at an oil and coolant temperature of 90±2° C., an oil pressure of 330±8 kPa, and an engine speed of 1,000±8 rpm, with periodic stoppage for wear measurements.

During operation, wear occurs on the lobes of the cam shaft and followers due to the sliding contact. Cam lobe wear was determined using the sequence V-D test described in ASTM Test No. STP 315H-Part 3 (the disclosure of which is incorporated herein by reference) by measuring the "head-to-toe" dimension (cam base circle diameter plus maximum lift) at room temperature using a digital micrometer. The difference between the dimensions of new and used cam lobes is a measure of the individual cam lobe wear, usually measured to an accuracy within about 2 microns. The individual cam lobe wear values from all eight lobes on the camshaft were averaged to provide a single value of average cam lobe wear.

EXAMPLE 1

Preparation of Butyl Ethoxyethylxanthate

A solution of butyl iodide in 150 ml of acetone was added (dropwise) to a mechanically stirred solution of 61.2 g of potassium ethoxyethylxanthate in 400 ml of acetone in a beaker on an ice bath. This mixture was stirred for 30 minutes and the precipitate thus formed filtered and washed with acetone. Acetone was removed from the combined filtrate and washes on a Rotovap under reduced pressure and the resulting oily product was dissolved in heptane. This oily product was again filtered and washed with heptane. Heptane was removed from the combined filtrate and washes on a Rotovap under reduced pressure and the residual oily product was subjected to vacuum for about 1 hour. The yield of the product was 62.2 g (93% conversion). Elemental analysis of the product gave the following results (in wt. %):

Found: C=49.18; H=8.1;
O=14.68; S=28.68.
Calculated for $C_9H_{18}O_2S_2$: C=48.65; H=8.11;
O=14.41; S=28.82.

Infrared and proton NMR spectra were consistent with this structure.

A portion of this product was used to formulate Oil 2 in Example 3 below.

EXAMPLE 2

Preparation of Decyl Ethoxyethylxanthate

About 110.5 g (0.5 mole) of 1-bromodecane was added (dropwise) to a magnetically stirred solution of 110.5 g (0.54 mole) of potassium ethoxyethylxanthate in 500 ml of acetone in a beaker. A precipitate formed immediately. An immediate precipitation of a solid was observed. About 200 ml of acetone was added and the stirring continued for an additional 2 hours. This mixture was then filtered to remove the solid and the resulting filtrate concentrated to dryness on a Rotovap. The residual oil was dissolved in toluene, washed with water (2×200ml) and dried over sodium sulfate. The solvent was removed from the solution under reduced pressure and the residue subjected to vacuum for about 1 hour. The yield of the product was 137 g. (89.5% conversion). Elemental analysis of the product gave the following results (in wt. %):

Found: C=58.65; H=9.72;
S=21.11.
Calculated for $C_{15}H_{30}O_2S_2$: C=58.8; H=9.8;
S=20.92

Infrared and proton NMR spectra were consistent with this structure.

A portion of this product was used to formulate Oil 3 in Example 3 below.

EXAMPLE 3

Formulation of Test Oils

Several test oils were formulated from a commercially available fully formulated lubricating oil from which the amount of antiwear additive (ZDDP) had been reduced until the oil contained 0.05 wt. % phosphorus (which corresponds to about 0.64 wt. % ZDDP). Two different alkyl alkoxyalkylxanthates were then added to different samples of this low phosphorus oil (Oil 1) to form the following oils:

Oil 2—contained 0.64 wt. % butyl ethoxyethylxanthate

Oil 3—contained 0.64 wt. % ZDDP and 0.5 wt. % decyl ethoxyethylxanthate

EXAMPLE 4

Valve Train Wear Tests Using Oils 1–3

Valve train wear tests were performed using Oils 1–3. The average cam lobe wear in micrometers (μm) was measured at 20 hour intervals during 60 hours of operation on each oil. The results obtained are shown in Table I below:

TABLE 1

| | Average Cam Lobe Wear, μm | | |
|---|---|---|---|
| Test Oil | 20 hr | 40 hr | 60 hr |
| Oil 1 | 19.4 | 43.2 | 65.7 |
| Oil 2 | 7.6 | 8.6 | 30.2 |
| Oil 3 | 27.9 | 70.8 | — |

The data in Table 1 show that Oil 2 provides excellent wear protection. In contrast, the wear protection for Oil 3 is worse than that obtained with Oil 1 (which does not contain any additional additive) even though the additives differ only in the number of carbon atoms in $R_3$. The data also show that this additive system allows the formulation of a lubricating oil having enhanced antiwear performance at phosphorus levels significantly below those of conventional oils.

What is claimed is:

1. A lubricating oil composition which comprises a major amount of a lubricating oil basestock and an additive mixture containing (a) from about 0.1 to about 5 wt. % of an alkyl alkoxyalkyxanthate having the formula $$R_1-O-R_2-O-\overset{\overset{\displaystyle S}{\|}}{C}-S-R_3$$

where $R_1$ is an alkyl group containing from 1 to 10 carbon atoms, $R_2$ is a straight or branched alkylene group containing from 2 to 4 carbon atoms, $R_3$ is a straight or branched alkyl group containing from 4 to 6 carbon atoms; and (b) from about 0.1 to about 2 wt. % of zinc dialykldithiophosphate.

2. The composition of claim 1 wherein the alkyl alkoxyalkylxanthate comprises butyl ethoxyethylxanthate.

3. The composition of claim 1 wherein from about 0.4 to about 1.5 wt. % of the alkyl alkoxyalkylxanthate and from about 0.5 to about 1 wt. % of the zinc dialkyldithiophosphate are present therein.

4. A method of improving the wear performance of an internal combustion engine by lubricating the engine with a lubricating oil comprising a major amount of a lubricating oil basestock and an additive mixture containing (a) from about 0.2 to about 5 wt. % of an alkyl alkoxyalkylxanthate having the formula $$R_1-O-R_2-\overset{\overset{\displaystyle S}{\|}}{O}-C-S-R_3$$

where $R_1$ is an alkyl group containing from 1 to 10 carbon atoms, $R_2$ is a straight or branched alkylene group containing from 2 to 4 carbon atoms, $R_3$ is a straight or branched alkyl group containing from 4 to 6 carbon atoms; and (b) from about 0.1 to about 2 wt. % of zinc dialkyldithiophosphate.

5. An additive concentrate suitable for blending with lubricating oils to provide a lubricating composition having improved antiwear performance which comprises an organic diluent and from about 10 to about 90 wt. % of an additive system containing (a) an alkyl alkoxyalkylxanthate having the formula $$R_1-O-R_2-O-\overset{\overset{\displaystyle S}{\|}}{C}-S-R_3$$

where $R_1$ is an alkyl group containing from 1 to 10 carbon atoms, $R_2$ is a straight or branched alkylene group containing from 2 to 4 carbon atoms, $R_3$ is a straight or branched alkyl group containing from 4 to 6 carbon atoms; and (b) zinc dialkyldithiophosphate.

6. The concentrate of claim 5 wherein the organic diluent is mineral oil, naphtha, benzene, toluene, or xylene.

7. The concentrate of claim 6 wherein the organic diluent comprises a mineral oil in which the additive system is soluble.

8. The concentrate of claim 6 wherein the alkyl alkoxyalkylxanthate comprises butyl ethoxyethylxanthate.

* * * * *